US007643020B2

(12) United States Patent
Salsman

(10) Patent No.: US 7,643,020 B2
(45) Date of Patent: Jan. 5, 2010

(54) DRIVING LIQUID CRYSTAL MATERIALS USING LOW VOLTAGES

(75) Inventor: Kenneth E. Salsman, Pleasanton, CA (US)

(73) Assignee: Intel Corporation, Santa Clara, CA (US)

( * ) Notice: Subject to any disclaimer, the term of this patent is extended or adjusted under 35 U.S.C. 154(b) by 1193 days.

(21) Appl. No.: 10/675,648

(22) Filed: Sep. 30, 2003

(65) Prior Publication Data

US 2005/0068277 A1 Mar. 31, 2005

(51) Int. Cl.
*G09G 3/34* (2006.01)

(52) U.S. Cl. ..... 345/204; 345/87; 345/90; 345/92; 345/99; 345/210

(58) Field of Classification Search ..... 345/87–104, 345/48, 204, 208, 210
See application file for complete search history.

(56) References Cited

U.S. PATENT DOCUMENTS

| | | | | |
|---|---|---|---|---|
| 3,975,286 | A * | 8/1976 | Oh | 252/299.64 |
| 5,317,307 | A | 5/1994 | Thomas, Jr. | 340/815.45 |
| 5,621,558 | A * | 4/1997 | Shimada et al. | 349/130 |
| 6,222,517 | B1 * | 4/2001 | Iba et al. | 345/94 |
| 6,317,121 | B1 * | 11/2001 | An | 345/211 |
| 6,693,617 | B2 * | 2/2004 | Sasaki et al. | 345/98 |
| 6,717,562 | B2 * | 4/2004 | Sandoe et al. | 345/92 |
| 6,762,743 | B2 * | 7/2004 | Yoshihara et al. | 345/102 |
| 6,771,339 | B2 * | 8/2004 | Knox et al. | 349/117 |
| 6,992,649 | B2 * | 1/2006 | Iba | 345/89 |
| 7,012,592 | B2 * | 3/2006 | Richards | 345/92 |
| 7,071,929 | B2 * | 7/2006 | Fujii | 345/204 |
| 2001/0048419 | A1 * | 12/2001 | Stevens | 345/89 |
| 2002/0140647 | A1 * | 10/2002 | Flynn et al. | 345/87 |
| 2002/0149720 | A1 | 10/2002 | Janssen et al. | |
| 2002/0191235 | A1 | 12/2002 | O'Connor et al. | |
| 2003/0053023 | A1 | 3/2003 | Chung et al. | |
| 2003/0147029 | A1 * | 8/2003 | Liu | 349/113 |
| 2004/0178976 | A1 * | 9/2004 | Jeon et al. | 345/87 |

FOREIGN PATENT DOCUMENTS

| | | |
|---|---|---|
| CN | 1371486 | 9/2002 |
| CN | 1698090 | 11/2005 |
| WO | WO 01/77747 | 10/2001 |
| WO | WO 04/001715 | 12/2003 |

OTHER PUBLICATIONS

Lindquist, et al., "Pulse-width modulation drive technique for high-resolution liquid-crystal gratings". Optics Letters, vol. 20, No. 5, pp. 510-512. Mar. 1, 1995.

* cited by examiner

*Primary Examiner*—Bipin Shalwala
*Assistant Examiner*—Vince E Kovalick
(74) *Attorney, Agent, or Firm*—Trop, Pruner & Hu, P.C.

(57) ABSTRACT

In one embodiment of the present invention, a liquid crystal display includes a liquid crystal cell having a liquid crystal material, and drive circuitry coupled to the liquid crystal cell to provide a low voltage signal to drive the liquid crystal cell. The low voltage signal may be a pulse width modulated signal, in one embodiment.

3 Claims, 3 Drawing Sheets

DRIVING LIQUID CRYSTAL MATERIALS USING LOW VOLTAGES

BACKGROUND

The present invention relates to driving liquid crystal materials, and more particularly to driving such materials using low voltage techniques.

Various liquid crystal (LC) displays (LCDs), such as twisted-nematic (TN) mode LC (TNLC) displays, use a varying voltage ramp to drive the LC material to a selected gray scale level (i.e., percentage of optical rotation of polarized light). This varying voltage ramp is typically in excess of 5 volts. Since the desired result is a gray scale video rate image, a frame time of 16.7 milliseconds (ms) (i.e., 60 Hertz (Hz)) is required. Typical TNLC materials take several milliseconds to switch from one state to another, and barely respond at video rates, and therefore do not provide a response time needed to react to very short voltage pulses.

Thus, acceptable drive schemes for TNLC displays utilize full frame time variable voltage analog or analog-like systems. However, such analog or amplitude modulated (AM) systems suffer from performance issues. These performance issues include the need for high voltages (greater than 5 volts, and typically 7.5 volts) for driving the display and gray scale performance (i.e., shading steps from black to white) that is non-linear. Further, this non-linear performance curve has significant changes in voltage position and slope (i.e., change per voltage increment) over small temperature changes, and thus deleteriously affects display performance.

Also a variable voltage (VV) drive is extremely sensitive to capacitive effects such as those caused by pixels that have dielectric coatings over electrode surfaces. This typically causes an offset of performance as the LC cell is driven in one electrical polarity versus the reverse polarity. Thus a typical VV drive scheme provides an optical response that is very asymmetrical. This asymmetrical response can lead to charge buildup in the cell, causing image sticking and may further result in damage to the LC display over time. Thus a need exists to provide a display to overcome these drawbacks.

DETAILED DESCRIPTION

In various embodiments of the present invention, displays may be driven using variable width square wave pulses. In such manner, the pulses may be used to select a desired gray scale level at which an LC material of the display operates. In certain embodiments, low voltage pulse width modulated (LV-PWM) signals may be used to control a TNLC material, for example. While the voltage used to control a display may vary in different embodiments, a signal of less than five volts may be desired, and in certain embodiments a signal having a voltage of between approximately 2.0 volts and 4.3 volts may be used. As used herein, the term "low voltage" means a voltage of less than 5 volts. In particular embodiments, a signal of less than or equal to 3.3 volts may be desired, as current device design rules used in the integrated circuit (IC) industry are generally limited to a maximum of 3.3 volts.

The PWM signals may vary in different embodiments, but in certain embodiments a duty cycle of between approximately 40 and 90% may be used, and in particular embodiments, a duty cycle between approximately 70-85% may be used. In such manner, the LC material may respond with a fast rise time and a fast fall time.

In certain embodiments, pixel array electronics may be utilized in accordance with current IC device rules. In such manner, a path to increased integration and fully digital drive electronics may be realized. Thus in certain embodiments, displays may be fabricated with pixel level digital drivers, and may be refreshed with frame updates, rather than progressive scanned updates to the pixels. Such frame updates may occur nearly instantaneously, giving a display a much higher duty cycle and making the resulting image much brighter.

In certain embodiments, a LV-PWM drive scheme in accordance with an embodiment of the present invention may exhibit much less sensitivity to capacitive effects, and provide an optical output from the LC cell that is substantially symmetrical. A PWM drive in accordance with an embodiment of the present invention may result in a nearly linear gray level response from high-speed TNLC materials driven in a birefringence mode. This linear response may eliminate the need for a lookup table for LC material response.

Figure 1:
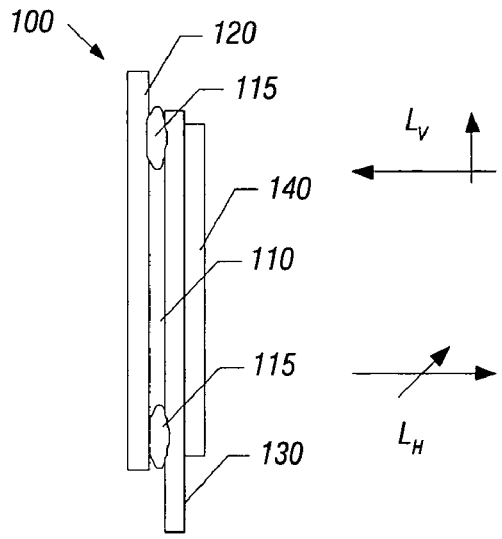
FIG. 1 is a cross section of a liquid crystal cell in accordance with one embodiment of the present invention.

Referring now to FIG. 1, shown is a cross-sectional view of a liquid crystal cell or display in accordance with one embodiment of the present invention. More specifically, cell 100 shown in FIG. 1 is a liquid crystal on silicon (LCOS) display, although the scope of the present invention is not limited in this regard.

As shown in FIG. 1, cell 100 includes a liquid crystal material 110 that is enclosed between a first substrate 120 and a second substrate 130. In one embodiment of a LCOS display, first substrate 120 may be a silicon backplane and second substrate 130 may be a cover glass. Liquid crystal material 110 may be enclosed by sealing members 115 which, in one embodiment, may be epoxy seals.

While not shown in FIG. 1, it is to be understood that pixel elements of cell 100 may be formed by providing a layer of reflective material, such as micromirrors patterned over first substrate 120 (and over control electrodes patterned thereon). Further, such pixel elements may also include a layer of antireflective material patterned over the reflective layer. Alternately in certain embodiments, second substrate 130 may include an antireflection coating. In one embodiment, a reflective layer may be formed from aluminum, for example, and an antireflective layer may be formed from silicon dioxide ($SiO_2$) and/or silicon nitride ($Si_3N_4$), for example.

In a LCOS display, first substrate 120 may have electrodes patterned thereon to provide control signals that drive the display. Also, second substrate 130 may include an electrode (e.g., an indium tin oxide (ITO) ground electrode) such that an electric field may be established between electrodes on first substrate 120 and glass 130. In certain embodiments, first substrate 120 and second substrate 130 may include alignment layers, such as polyimide layers.

In various embodiments, liquid crystal material 110 may be a twisted-nematic material, super twisted nematic material, ferroelectric liquid crystal material, surface-stabilized ferroelectric liquid crystal material, polymer dispersed liquid crystal material, electro-chromic liquid crystal material and the like. In certain embodiments, vertical aligned nematic (VAN), hybrid aligned nematic, electrically controlled birefringence, pi-cell or other alignment modes may be used.

Also shown in FIG. 1 is a partial polarization rotation retardation material 140 which may be placed above second substrate 130 to provide a partial rotation of polarized light. While shown as being directly located on second substrate 130, in certain embodiments an air gap may be present between second substrate 130 and material 140 via use of spacers. In certain embodiments, a user-controlled adjustment mechanism may be provided for a user to control the gap, thus controlling the rotation angle. In certain embodiments, the partial wave retardation material may be used to enhance the performance of the LC material by providing a complete rotation of polarized light from the incident polarization alignment to an output of 90 degrees to the incident alignment. In one such embodiment, a retardation film having less than a quarter wave retardation may be used. Alternately, the material may be deposited onto second substrate 130, such as by a spin coating process.

The material used for partial wave retardation may vary in different embodiments. In one embodiment, the material may be an acetate material, such as a stretched acetate. For example, in a VAN mode display, a triacetyl-cellulose (TAC) film may be used. The thickness of such a film (or films) may vary, but in certain embodiments the thickness may be between approximately 60 nanometers (nm) and approximately 240 nm, and a film of 180 nm may be used in one desired embodiment. In another embodiment, the material may be a polycarbonate material. In different embodiments, a film may be between 0.2 mils and 1.0 mils thick, and in certain desired embodiments, may be between approximately 0.5 mils and 0.8 mils. Also, the amount of wave retardation may vary in certain embodiments. While in certain embodiments the amount of retardation may be minimal, in other embodiments polarization may be retarded by up to approximately a quarter wave. In certain embodiments however, the actual wave retardation may be much less than a quarter wave for example, ⅛ or 1/16.

Also, while shown in FIG. 1 as being coupled to second substrate 130, in other embodiments partial wave retardation material 140 may be coupled to adjacent optics, such as a prism of an optical engine (not shown in FIG. 1). In other embodiments, such a retardation material need not be used, particularly if a drive with a voltage greater than approximately 4.0 volts, and desirably between approximately 4.0 and 4.5 volts is used. Further, such a retardation material need not be used with a VAN mode LC material.

As shown in FIG. 1, in operation incoming light $L_v$ having a vertical polarization may be directed onto display 100, and the resulting light $L_h$ exiting display 100 may be reflected with a horizontal polarization, if no voltage is applied to the pixels of the display. In one embodiment, a display in accordance with an embodiment of the present invention may be a digitally driven LCOS microdisplay having an active matrix backplane.

While not shown in FIG. 1, it is to be understood that display 100 may include additional standard features of an LC display. For example, in certain embodiments (e.g., an LCD embodiment) one or both of first substrate 120 and second substrate 130 may include polarizing films having polarities separated by 90°.

In certain embodiments, a relatively thin cell gap may be provided in an LC material. The cell gap may be the thickness or distance between first substrate 120 and second substrate 130, as shown in FIG. 1. Thus, the cell gap may refer to the thickness of the liquid crystal material sandwiched between respective enclosures. While cell gaps may vary in different embodiments, a cell gap of approximately 1 micron may be used in one embodiment, and the thickness of liquid crystal material 110 may vary between approximately 0.5 microns and 1.5 microns in other embodiments. As shown in FIG. 1, epoxy seals 115 (and spacers in the cell gap, not shown in FIG. 1) may be used to form a cell gap such that a substantially uniform thickness exists in liquid crystal material 110.

In such manner, a lower voltage may be used to drive the material, due to the relativity thin cell gap. The material may exhibit a faster response time for the same reason.

Figure 2:
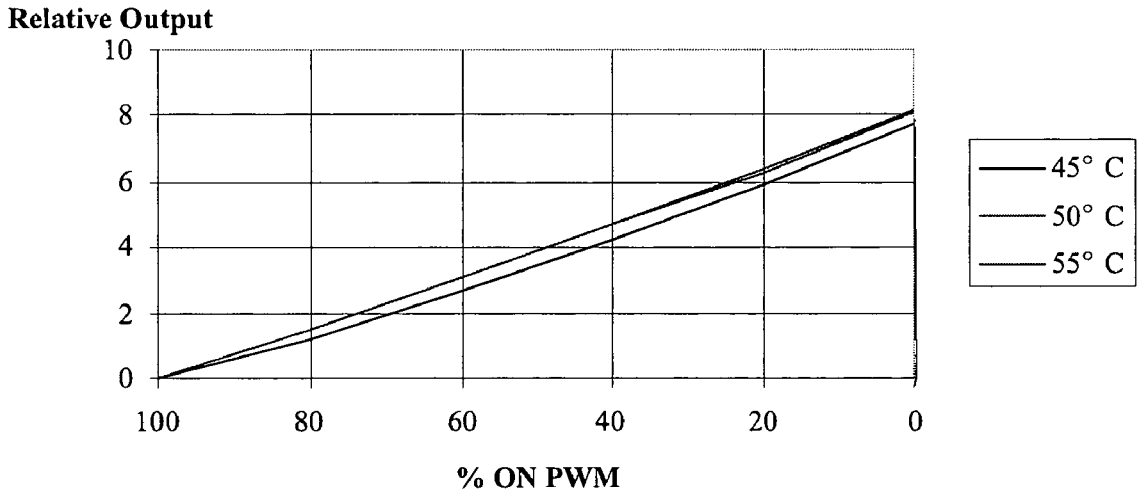
FIG. 2 is a graphical representation of relative output versus percentage of pulse width modulation of a display in accordance with one embodiment of the present invention.

Referring now to FIG. 2, shown is a transition curve of a display in accordance with one embodiment of the present invention. As shown in FIG. 2, when driven using a LV-PWM signal, a linear response results and little change with temperature occurs. Specifically, at temperatures of 45° Celsius (C.), 50° C., and 55° C., the relative output (i.e., relative intensity) is substantially linear as a function of a LV-PWM signal. Further, the relative output is approximately 0 at 100% duty cycle, and linearly progresses to approximately 8 (or 80%) at a 0% duty cycle. In such an embodiment, a single variable linear function may be used to fully compensate for the performance shift, instead of a multi-variable curve function lookup table, thus minimizing any necessary memory in the control system for thermal stabilization.

Such thermal stabilization may aid in performing rapid color gamut control. Because no tables are needed for temperature compensation, digital control information may be provided to a gamut control table to select desired color values. The output of such a gamut control table may be used in providing control signals to the electrodes of the display.

Figure 3:
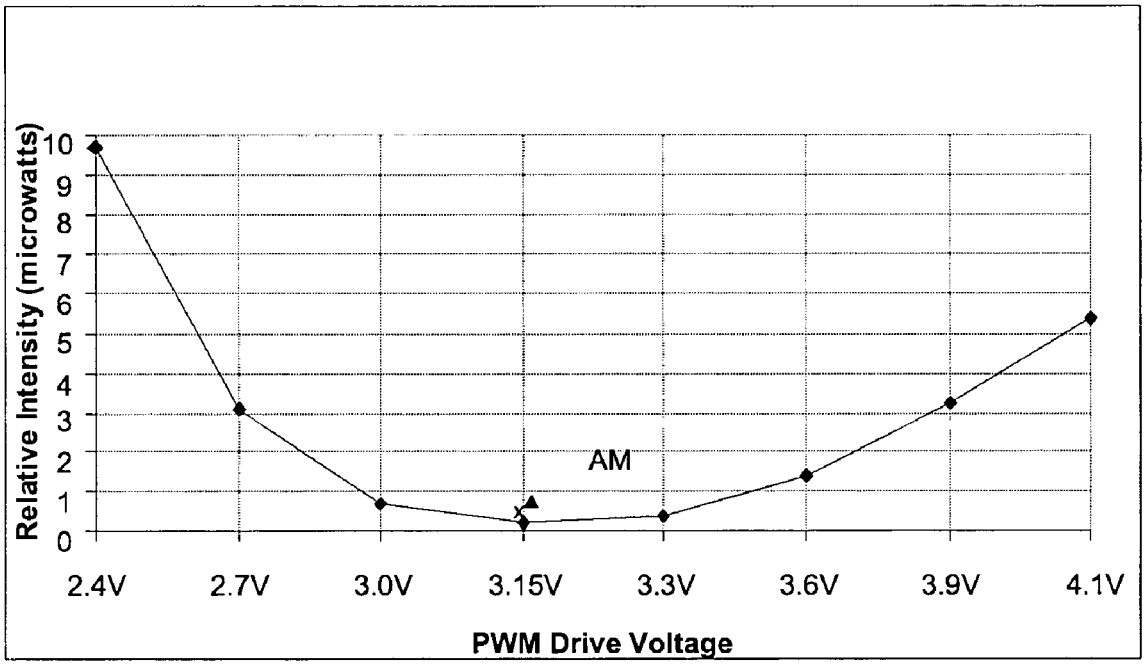
FIG. 3 is a graphical representation of relative intensity versus pulse width modulation drive voltage of a display in accordance with one embodiment of the present invention.

Referring now to FIG. 3, shown is a graphical representation of relative intensity versus PWM drive voltage in accordance with one embodiment of the present invention. As shown, a relative intensity of less than approximately 1 microwatt (μW) occurs with a drive voltage between approximately 3.0 volts and 3.3 volts, and a minimum relative intensity occurs at a drive voltage of approximately 3.15 volts. Also shown in FIG. 3 is a point marked "AM", which shows the minimum intensity of an analog voltage drive at approximately 7.5 volts on the same material in the same optical conditions as compared to a LV-PWM drive in accordance with one embodiment of the present invention.

In certain embodiments, the combination of a thin cell gap and a LV-PWM drive signal may provide a nearly linear gray scale response at video frame rates of 60 Hz. Further, the combination of a thin cell gap with a partial optical wave plate retarder and a LV-PWM drive signal may allow the LC material to respond with an optical response that is similar to the drive signal. Such an optical PWM output may result in a linear gray scale response that is nearly an image of the electrical drive pulse that generates it. In such manner, an optically digital response to an electrically digital drive may be effected.

Because of the high speed switching afforded by embodiments of the present invention, displays in accordance with various embodiments may be switched at speeds much higher than video rates (i.e., 60 Hz). For example, in certain embodiments, switching may be effected between approximately 120 Hz and 360 Hz, although the scope of the present invention is not limited in this regard. In such manner, a color sequential system may be implemented, and images of two or three colors may be provided out of a display during each video cycle.

LC cell 100 may be part of an optical projection device in one embodiment. In such an embodiment, LC cell 100 may be a LCOS light modulator, such as a LCOS cell to reflect a single color, such as red, green, or blue (or other color schemes). Alternately, a LCOS cell may be adapted to modulate light of two colors or three colors. It is to be appreciated that in other embodiments, LC cell 100 may be used in connection with other types of optical devices. These optical devices may include, but not be limited to, rear and front-end projectors, virtual near-to-eye devices, and the like.

In one embodiment, a LC cell may be used as a spatial light modulator (SLM), which is a multipixel opto-electronic device that modulates light intensity that is imaged by its pixels by reflecting (or in some embodiments by transmitting) controllable amounts of light independently at each pixel. In one embodiment, such an SLM may be a LCOS microdisplay. Alternately such an SLM may be a LCD, digital mirror device (DMD), grating light valve (GLV) or the like.

Figure 4:
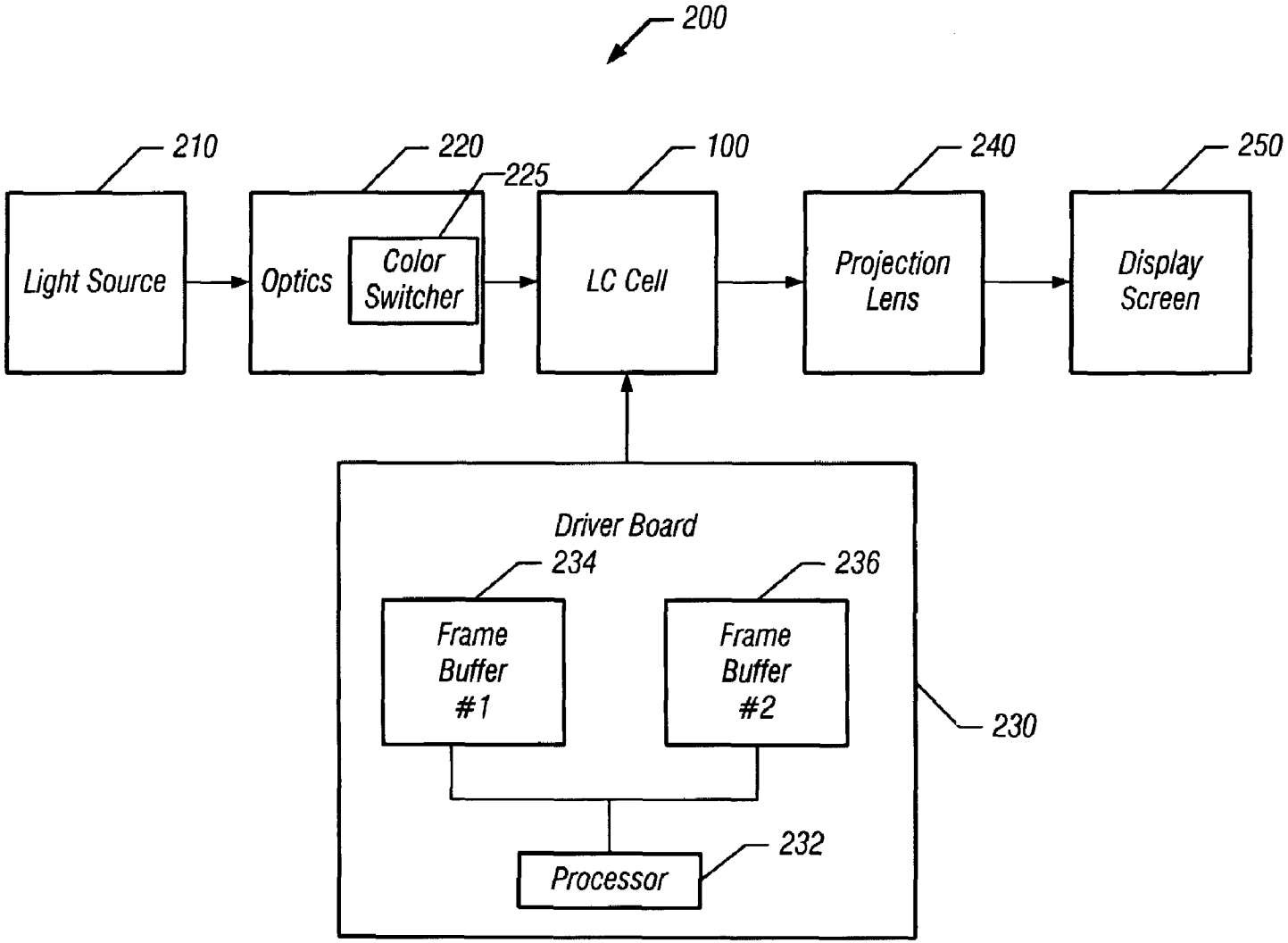
FIG. 4 is a block diagram of a display system in accordance with one embodiment of the present invention.

Referring now to FIG. 4, shown is a block diagram of a display system in accordance with one embodiment of the present invention. The display system may be any desired display such as a rear or front projection screen, a heads-up display, virtual near-to-eye device and the like.

As shown in FIG. 4, display system 200 may include one or more light sources 210. The light sources may be any desirable form of light, including, for example arc or plasma lamps, lasers, light emitting diodes or the like.

As shown in FIG. 4, light source 210 is provided to optics 220. Such optics may include, for example, a condensing lens, a shaping lens, and other optical devices. Also, in certain embodiments, optics 220 may include a color filter or a color switching mechanism, such as a color wheel or color switcher 225, to provide one or more desired colors to LC cell 100. Also in an embodiment in which LC cell 100 is LCOS cell, optics 220 may also include a polarizer to polarize incident light on LC cell 100.

A driver board 230 may coupled to provide drive signals to LC cell 100 to modulate the incident light into a desired image. In one embodiment, driver board 230 may include a processor 232 and one or more memories 234 and 236. Driver board 230 may be coupled to LC cell 100 via, for example, a flexible cable or the like. In various embodiments, the processor may be a general-purpose microprocessor, or a special-purpose processor such as a microcontroller, application specific integrated circuit (ASIC), a programmable gate array (PGA) and the like. Further, the memory or memories may be static random access memories (SRAMs), in one embodiment. Driver board 230 or another location in display system 200 may include one or more computer programs stored on a storage medium having instructions to operate the system in accordance with an embodiment of the present invention. The storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

In operation, the processor 232 of driver board 230 may provide signals to the one or more memories 234 and 236 to form a representation of an image. The memories of driver board 230 may act as buffers to store alternating frames of the image. In turn, each memory may be read out to LC cell 100 to enable electrodes controlling the cell to activate the desired pixel elements of the cell. In such manner, frame updates may be provided to LC cell 100, thereby allowing high speed switching of images on LC cell 100.

Light exiting LC cell 100 having the formed image therein is provided to a projection lens 240, which projects the image on a display screen 250. In an embodiment using a LCOS cell, projection lens 240 may also include a polarizer to polarize the light. In one embodiment, projection lens 240 may also include a turning mirror to reflect projected light onto display screen 250.

While shown in FIG. 4 as including a single LC cell 100, it is to be understood that in other embodiments a plurality of such cells may be present. For example, in one embodiment three LC cells may be present in a display system such that each cell is adapted to modulate light of a given color. In such manner, in a red, green, blue (R, G, B) color space each cell may receive incident light of a given color and provide a modulated image of the same color. In yet another embodiment, two LC cells may be present. In such an embodiment, for example, one LC cell may be dedicated to modulating green light, and the other cell may modulate both red and blue light. In such an embodiment, a color wheel having red and blue components may be located in the incident light path of the red and blue LC cell. In other embodiments, a single LC cell may be dedicated to the red color and a separate LC cell may modulate both blue and green colors.

In one embodiment, optics 220 may include a polarizing beam splitter (PBS), and light exiting LC cell 100 may be reflected back through the PBS of optics 220 and provided therefrom to projection lens 240.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

providing a pulse width modulated signal to a liquid crystal cell having a cell gap of from 0.5 to 1.5 microns; and driving a data electrode of the liquid crystal cell without using a voltage greater than 3.3 volts.

2. An article comprising a machine-readable storage medium containing instructions that if executed enable a system to:

form a pulse width modulated signal;

provide the signal to a liquid crystal cell having a cell gap of from 0.5 to 1.5 microns; and drive a data electrode of the liquid crystal cell without using a voltage greater than 3.3 volts.

3. The article of claim 2, further comprising instructions that if executed enable the system to drive the liquid crystal cell with a pulse width modulated signal.

* * * * *